US011466524B2

(12) United States Patent
Johnson et al.

(10) Patent No.: US 11,466,524 B2
(45) Date of Patent: Oct. 11, 2022

(54) CLOSED-LOOP HYDRAULIC DRILLING

(71) Applicant: AMERIFORGE GROUP INC., Houston, TX (US)

(72) Inventors: Austin Johnson, Houston, TX (US); Kareem Amer, Houston, TX (US); Justin Fraczek, Spring, TX (US)

(73) Assignee: GRANT PRIDECO, INC., Houston, TX (US)

( * ) Notice: Subject to any disclaimer, the term of this patent is extended or adjusted under 35 U.S.C. 154(b) by 0 days.

(21) Appl. No.: 17/523,570

(22) Filed: Nov. 10, 2021

(65) Prior Publication Data

US 2022/0065099 A1 Mar. 3, 2022

Related U.S. Application Data

(63) Continuation of application No. PCT/US2020/032481, filed on May 12, 2020.
(Continued)

(51) Int. Cl.
*E21B 21/10* (2006.01)
*E21B 21/08* (2006.01)
(Continued)

(52) U.S. Cl.
CPC ..... *E21B 21/10* (2013.01); *E21B 21/01* (2013.01); *E21B 21/08* (2013.01); *E21B 34/025* (2020.05); *E21B 47/06* (2013.01); *E21B 21/085* (2020.05)

(58) Field of Classification Search
CPC ..... E21B 21/10; E21B 21/01; E21B 21/08; E21B 21/085; E21B 43/08; E21B 47/06; E21B 47/13
See application file for complete search history.

(56) References Cited

U.S. PATENT DOCUMENTS 6,176,323 B1 1/2001 Weirich et al.
10,883,357 B1 * 1/2021 Orbell ..... E21B 47/06
(Continued)

FOREIGN PATENT DOCUMENTS

WO 2018183861 A1 10/2018

OTHER PUBLICATIONS

PCT International Search Report of International Search Authority (USPTO) for PCT International Application PCT/US2020/032481, filed May 12, 2020, dated Jul. 24, 2020.
(Continued)

*Primary Examiner* — Brad Harcourt
(74) *Attorney, Agent, or Firm* — Basil M. Angelo; Angelo IP

(57) ABSTRACT

A closed-loop hydraulic drilling system generates choke characteristic curves or data that more accurately reflects the relationship between the commanded choke valve position and the resulting pressure drop across the choke valve for a given flow rate and fluid density. The choke characteristic curves may be generated through a calibration procedure and then used during normal operations to more accurately monitor return flow and manage wellbore pressure. The specific gravity of an injected calibration fluid and pressure drop across the choke valve may be determined and correlated to the current choke valve position to reflect the choke characteristic curve in situ, thereby providing for more precise control of wellbore pressure and enabling condition monitoring of the choke valve. In addition, an improved closed-loop hydraulic drilling system does not require a flow meter, enabling the adoption of MPD systems in low-specification and economically constrained applications.

15 Claims, 14 Drawing Sheets

Related U.S. Application Data

(60) Provisional application No. 62/848,804, filed on May 16, 2019.

(51) Int. Cl.

| | |
|---|---|
| ***E21B 34/02*** | (2006.01) |
| ***E21B 21/01*** | (2006.01) |
| ***E21B 47/06*** | (2012.01) |

(56) References Cited

U.S. PATENT DOCUMENTS

| | | | | |
|---|---|---|---|---|
| 2008/0041149 | A1 | 2/2008 | Leuchtenberg | |
| 2011/0114387 | A1 | 5/2011 | Belcher et al. | |
| 2014/0273831 | A1* | 9/2014 | Walton | E21B 43/14 455/41.1 |
| 2015/0240579 | A1* | 8/2015 | Lovorn | E21B 21/08 166/250.01 |
| 2016/0076322 | A1* | 3/2016 | Oddie | E21B 21/10 73/152.51 |
| 2016/0138351 | A1* | 5/2016 | Dillard | E21B 21/106 175/25 |
| 2016/0298401 | A1 | 10/2016 | Cotten et al. | |
| 2017/0328151 | A1* | 11/2017 | Dillard | E21B 21/08 |
| 2018/0163489 | A1* | 6/2018 | Dillard | E21B 44/00 |
| 2020/0318746 | A1* | 10/2020 | Parthasarathy | F16K 3/34 |

OTHER PUBLICATIONS

PCT Written Opinion of International Search Authority (USPTO) for PCT International Application PCT/US2020/032481, filed May 12, 2020, dated Jul. 24, 2020.

USPTO notice of allowance issued in U.S. Appl. No. 17/523,506, filed Nov. 10, 2021, dated Mar. 25, 2022.

USPTO non-final Office Action issued in U.S. Appl. No. 17/523,506, filed Nov. 10, 2021, dated Feb. 15, 2022.

* cited by examiner

CLOSED-LOOP HYDRAULIC DRILLING

BACKGROUND OF THE INVENTION

A closed-loop hydraulic drilling system uses a wellbore sealing system, one or more components of which are sometimes referred to individually or collectively as a managed pressure drilling ("MPD") system, to actively manage wellbore pressure during drilling and other operations.

In onshore and certain shallow water applications, a conventional blowout preventer ("BOP") is disposed on the surface above the wellbore. The MPD system typically includes an annular sealing system, or functional equivalent thereof, affixed to the top of, and in fluid communication with, the BOP. The annular sealing system typically includes a rotating control device ("RCD"), an active control device ("ACD"), or other type of annular sealing system that seals the annulus surrounding the drill string while the drill string is rotated. A side return port, either integrated into the housing of the annular sealing system itself or configured as a separate component interposed between the BOP and the annular sealing system, diverts returning fluids from the annulus below the annular seal to the drilling rig. The side return port is in fluid communication with a choke valve that is in fluid communication with a mud-gas separator, shale shaker, or other fluids processing system configured to receive returning fluids to be recycled and reused. The encapsulation of the annulus allows for the application of surface backpressure, and thereby control of wellbore pressure, through manipulation of the choke valve that diverts the returning fluids to the rig.

In offshore, including deepwater, applications, a subsea blowout preventer ("SSBOP") is typically disposed at or near the sea floor above the wellbore. The MPD system typically includes an annular sealing system, a drill string isolation tool, and a flow spool, or functional equivalents thereof, in fluid communication with the SSBOP by way of a marine riser system. The annular sealing system typically includes an RCD, ACD, or other type of annular sealing system that seals the annulus surrounding the drill string while the drill string is rotated. The drill string isolation tool, or equivalent thereof, is disposed directly below the annular sealing system and includes an annular packer that controllably encapsulates the well and maintains annular pressure when rotation has stopped or the annular sealing system, or components thereof, are being installed, serviced, removed, or otherwise disengaged. The flow spool, or equivalent thereof, is disposed directly below the drill string isolation tool and, as part of the pressurized fluid return system, controllably diverts returning fluids from the annulus below the annular seal to the surface. The flow spool includes a side return port that is in fluid communication with a choke valve, typically disposed on a platform of the floating rig, that is in fluid communication with a mud-gas separator, shale shaker, or other fluids processing system configured to receive returning fluids to be recycled and reused. The encapsulation of the annulus allows for the application of surface backpressure, and thereby control of wellbore pressure, through manipulation of the choke valve that diverts returning fluids to the rig.

In both onshore and offshore applications, the pressure tight seal on the annulus allows for control of wellbore pressure by manipulation of the choke valve position, which is directly related to the choke aperture, of the choke valve and the corresponding application of surface backpressure. For example, in certain applications, an MPD system may be used to maintain wellbore pressure within a pressure gradient bounded by the pore pressure and the fracture pressure to avoid the unintentional influx of unknown formation fluids, sometimes referred to as a kick, into the well or marine riser or fracture the formation resulting in the loss of expensive drilling fluids to the formation. Similarly, in other exemplary applications, applied surface backpressure ("ASBP"), commonly referred to as ASBP-MPD, may be used to augment the annular pressure profile and improve the response capability to drilling contingencies. As drillers take on more challenging well plans, the ability to control wellbore pressure is becoming increasingly more important to the feasibility, economic viability, and safety of operations. However, the cost and complexity of such systems is a barrier to adoption, particularly in low-specification and low-cost applications.

BRIEF SUMMARY OF THE INVENTION

According to one aspect of one or more embodiments of the present invention, an improved closed-loop drilling system includes a primary fluid pumping system capable of injecting drilling fluids into a wellbore through a drill string, an annular sealing system that seals an annulus surrounding the drill string, a side return port disposed below the annular sealing system that diverts returning fluids from the annulus to a choke valve via a fluid return line, a wellbore isolation valve that controllably isolates the fluid return line from the annulus, a secondary fluid pumping system that controllably injects calibration fluids into the fluid return line towards the choke valve, a first meter disposed in line with the fluid return line and upstream of the choke valve that provides a measurement of a fluid density or specific gravity or data thereof to a data acquisition and control system, a first pressure sensor disposed upstream of the choke valve that provides a measurement of upstream pressure to the data acquisition and control system, and a second pressure sensor disposed downstream of the choke valve that provides a measurement of downstream pressure to the data acquisition and control system. The data acquisition and control system generates a choke performance curve, choke characteristic curve, or data thereof by closing the wellbore isolation valve, engaging the secondary fluid pumping system, varying a commanded choke setting of the choke manifold through a plurality of set points, and recording a pressure drop across the choke valve at each of the set points.

According to one aspect of one or more embodiments of the present invention, a method of closed-loop drilling includes sealing an annulus surrounding a drill string with an annular sealing system, isolating a fluid return line from the annulus with a wellbore isolation valve, injecting calibration fluids from a secondary fluid pumping system into the fluid return line towards a choke valve, determining a fluid density or specific gravity with a first meter disposed in line with the fluid return line upstream of the choke valve, determining a first pressure upstream of the choke valve, and determining a second pressure downstream of the choke valve. A commanded choke setting of the choke valve is varied through a plurality of set points and a pressure drop across the choke valve at each of the set points is recorded. A choke performance curve, choke characteristic curve, or data thereof, is generated showing the commanded choke setting and corresponding pressure drop across the choke valve for a given fluid density and injection flow rate of the calibration fluids.

Other aspects of the present invention will be apparent from the following description and claims.

DETAILED DESCRIPTION OF THE INVENTION

Figure 1A:
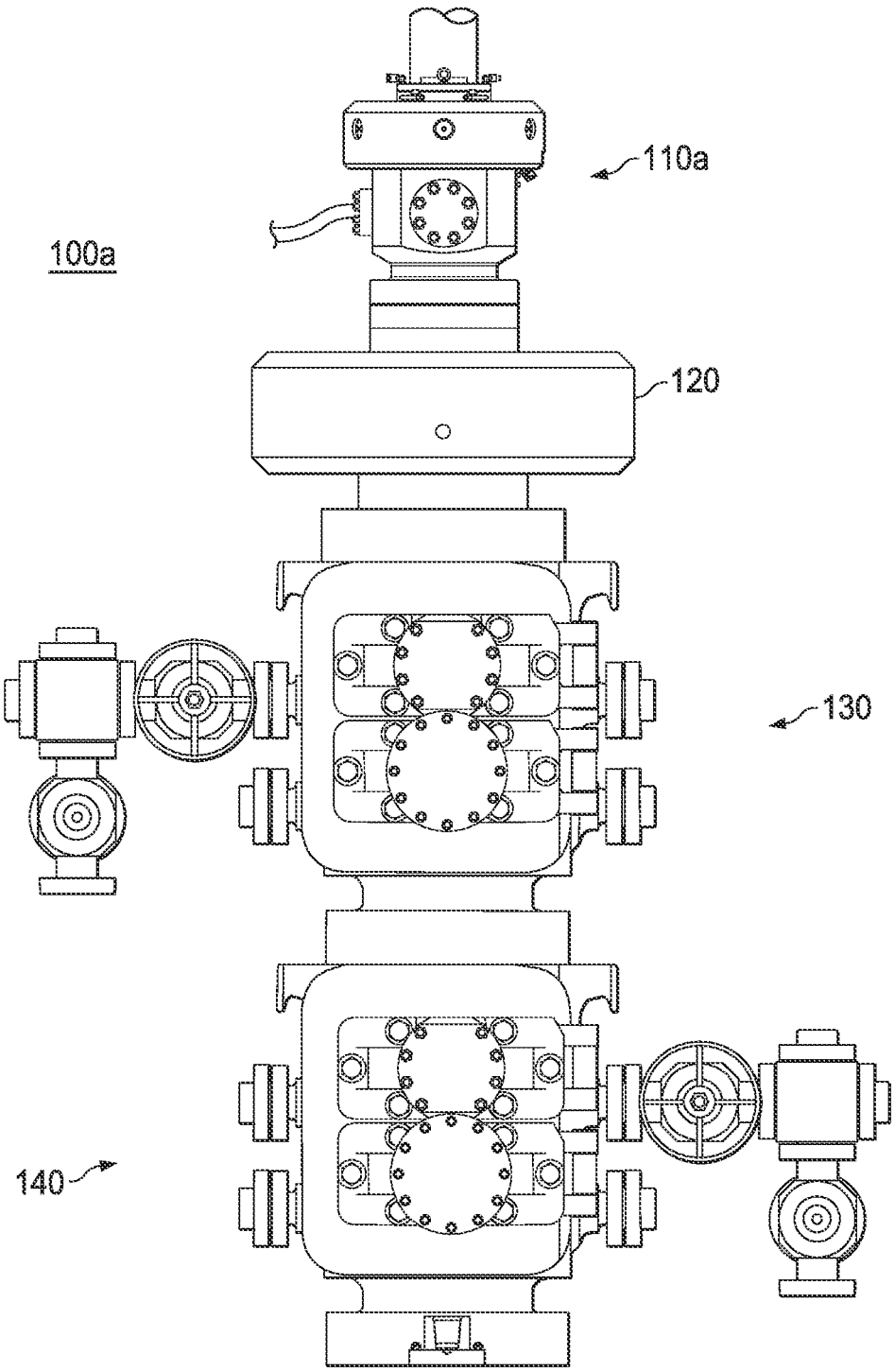
FIG. 1A PRIOR ART
FIG. 1A shows a portion of a conventional MPD system used in onshore and certain shallow offshore applications to manage wellbore pressure.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are purposefully not described to avoid obscuring the description of the present invention.

FIG. 1A shows a portion of a conventional MPD system 100*a* used in onshore and certain shallow water applications to manage wellbore pressure for purposes of illustration only. A conventional onshore or shallow water MPD system 100*a* typically includes an annular sealing system 110*a*. Annular sealing system 110*a* may be an RCD-type, ACD-type (not shown), or other type or kind of sealing system (not shown) that seals the annulus surrounding the drill string such that the annulus is encapsulated and is not exposed to the atmosphere. Annular sealing system 110*a* may fluidly communicate with an annular 120, a BOP 130, and a wellhead structure 140 disposed over a wellbore (not shown). A drill string (not shown) may be disposed through a common lumen that extends through annular sealing system 110*a*, annular 120, BOP 130, and wellhead 140, into the wellbore (not shown). As used herein, lumen means an interior passageway of a tubular or structure that may vary in diameter along the passageway. Drilling fluids (not shown) may be pumped downhole through the interior passageway of the drill string (not shown) and return in the annulus surrounding the drill string. Annular sealing system 110*a* may include at least one sealing element (not shown) that seals the annulus (not shown) that surrounds the drill string (not shown). A side return port (not shown) may divert returning annular fluids from the annulus below the annular seal to a mud-gas separator (not shown), shale shaker (not shown), or other fluids processing system (not shown) on the rig (not shown) that recycles returning fluids for reuse. The annular pressure may be managed by manipulating a choke aperture of a choke valve (not shown) disposed on the rig (not shown). Onshore and certain shallow water applications are sometimes referred to as low-specification or low-cost applications because of the economic constraints imposed on the implementation of the MPD portion of the drilling system, if any.

Figure 1B:
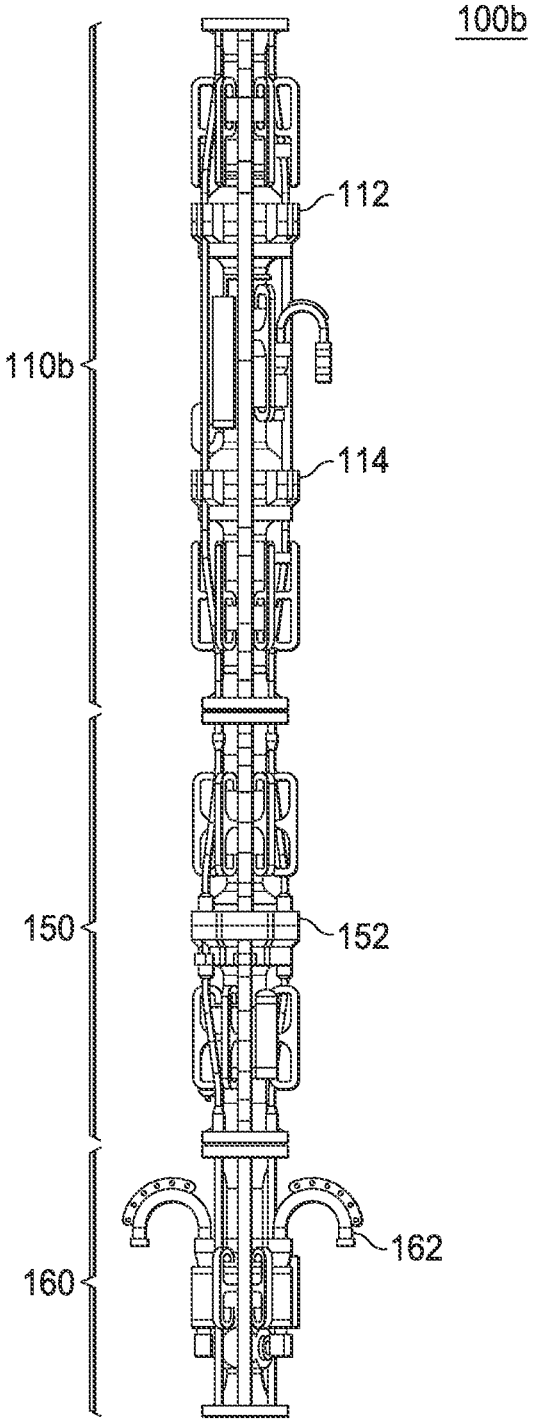
FIG. 1B PRIOR ART
FIG. 1B shows a portion of a conventional MPD system used in offshore applications to manage wellbore pressure.

FIG. 1B shows a portion of a conventional MPD system 100*b* used in offshore applications to manage wellbore pressure for purposes of illustration only. A floating platform (not shown), such as, for example, a semi-submersible, drillship, drill barge, or other floating rig or vessel is typically disposed over a body of water (not shown) to facilitate drilling or other operations. A marine riser system (not independently illustrated) provides fluid communication between the floating platform (not shown) and the lower marine riser package ("LMRP") or SSBOP (not shown) disposed on or near the ocean floor. The LMRP or SSBOP (not shown) may be in fluid communication with the wellhead (not shown) of the wellbore (not shown). In conventional below-tension-ring configurations, MPD system 100*b* may be disposed below the telescopic joint (not shown) as part of the upper portion of the marine riser system (not independently illustrated). MPD system 100*b* may include an annular sealing system 110*b*, or equivalent thereof, disposed below a bottom distal end of the outer barrel of the telescopic joint (not shown), a drill string isolation tool 150, or equivalent thereof, disposed directly below annular sealing system 110*b*, and a flow spool 160, or equivalent thereof, disposed directly below drill string isolation tool 150. Annular sealing system 110*b* may be an ACD-type, RCD-type (not shown), or other type or kind of sealing system (not shown) that seals the annulus surrounding the drill string such that the annulus is encapsulated and is not exposed to the atmosphere. In the ACD-type embodiment depicted, annular sealing system 110*b* may include an upper sealing element 112 (not shown, reference numeral depicting general location only) and a lower sealing element 114 (not shown, reference numeral depicting general location only) that seal the annulus surrounding the drill string (not shown).

Drill string isolation tool 150, or equivalent thereof, may be disposed directly below annular sealing system 110*b* and provides an additional sealing element 152 (not shown, reference numeral depicting general location only) that encapsulates the well and seals the annulus surrounding the drill string (not shown), typically when rotation has stopped or annular sealing system 110*b*, or components thereof, are being installed, serviced, maintained, removed, or otherwise disengaged. For example, when sealing elements 112, 114 (not shown, reference numeral depicting general location only) require replacement while the marine riser (not independently illustrated) is pressurized, such as, for example, during hole sections in between bit runs, drill string isolation tool 150 may be engaged to maintain annular pressure while annular sealing system 110 is taken offline. To ensure the safety of operations, sealing element 152 (not shown, reference numeral depicting general location only) may seal the annulus surrounding the drill string while sealing elements 112, 114 (not shown, reference numeral depicting general location only) of annular sealing system 110*b* are removed and replaced. Flow spool 160, or an equivalent thereof, may be disposed directly below drill string isolation tool 150 and, as part of the pressurized fluid return system, divert returning fluids from below the annular seal 110*b* to the surface. Flow spool 160 may include one or more side return ports 162 that are in fluid communication with a choke valve (not shown), typically disposed on the floating platform of the rig (not shown), that is in fluid communication with a mud-gas separator (not shown), shale shaker (not shown), or other fluids processing system (not shown) on the rig (not shown) that recycles returning fluids for reuse. The annular pressure may be managed by manipulating a choke aperture of the choke valve (not shown) disposed on the rig (not shown). Offshore, especially deepwater, applications are typically considered high-specification and high-cost applications because of the complexity of operations, risk mitigation, and substantial economic investment required to field such MPD equipment offshore.

One of ordinary skill in the art will recognize that the conventional Applied Surface Back Pressure MPD systems 100 depicted and described herein are merely exemplary and may vary in the type or kinds of components used in accordance with one or more embodiments of the present invention. However, all such embodiments seal the annulus surrounding the drill string and divert returning fluids from the annulus below the annular seal to a choke valve that controllably applies surface backpressure to control wellbore pressure.

Figure 2:
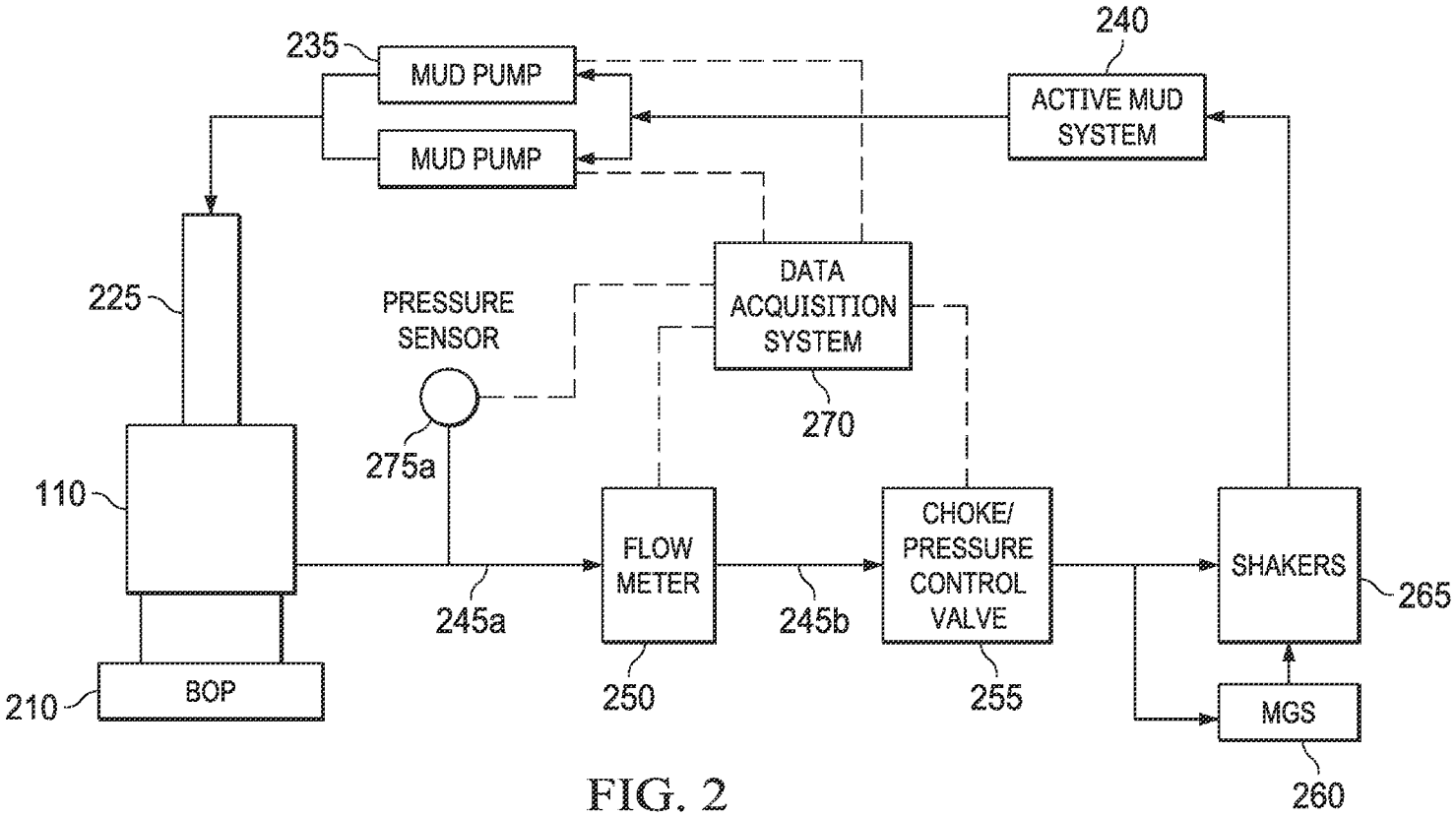
FIG. 2 PRIOR ART
FIG. 2 shows a conventional closed-loop drilling system for drilling a subterranean wellbore.

FIG. 2 shows a conventional closed-loop drilling system 200 for drilling a subterranean wellbore (not shown) in an onshore, shallow water, or offshore application. However, a low-cost closed-loop drilling system 200 may be more commonly be found as part of a land-based drilling rig. As discussed above, in onshore or shallow water applications, BOP 210 may be disposed over, and in fluid communication with, a wellhead (not shown) disposed above, and in fluid communication with, a wellbore (not shown). In offshore, including deepwater, applications, BOP 210 may be a SSBOP disposed on or near the subsea surface (not shown) and in fluid communication with a wellhead (not shown) disposed above, and in fluid communication with, a subsea wellbore (not shown). BOP 210 may be disposed below, and in fluid communication with, a marine riser system (not shown) that fluidly communicates with the conventional MPD system. One of ordinary skill in the art will recognize that the following discussion, while applicable to onshore, shallow water, and offshore applications, will be focused on aspects of the MPD system that are applicable to all such applications.

A conventional MPD system (e.g., 100 of FIG. 1) may include an annular sealing system 110. The annular sealing system 110 may be an ACD-type (e.g., 110*b* of FIG. 1*b*), RCD-type (e.g., 110*a* of FIG. 1*a*), or other type or kind (not shown) of sealing system that seals the annulus (not shown) surrounding the drill string 225 such that the annulus (not shown) is encapsulated and not exposed to the atmosphere. The drill string 225 may include a bottomhole assembly (not shown) or drill bit (not shown) used to drill the well (not shown). One or more mud pumps 235, sometimes referred to herein as the primary fluid pumping system, may be used to pump drilling fluids (not shown) from an active mud system 240 through drill string 225 to facilitate drilling operations. The returning fluids (not shown) return to the surface through the annulus (not shown) surrounding drill string 225. Specifically, returning fluids (not shown) are diverted from a side return port (not shown) disposed below annular sealing system 110, to a fluid return line 245*a*. A pressure sensor 275*a* may measure hydrostatic pressure of the returning fluids (not shown). Fluid return line 245*a* may be in fluid communication with a flow meter 250 which is in fluid communication with a choke valve 255 via another segment of the fluid return line 245*b*. The returning fluids (not shown) may be controllably diverted by choke valve 255 to one or more fluids processing systems such as, for example, mud-gas-separator 260 and/or shale shaker 265 prior to returning fluids (not shown) to active mud system 240.

During conventional drilling operations, a data acquisition and control system 270 may receive pressure sensor 275*a* data and flow meter 250 data, control the flow rate of the mud pumps 235, and command the choke valve 255 to a desired choke aperture setting. The pressure tight seal on the annulus provided by annular sealing system 110 allows for the control of wellbore pressure by manipulation of the choke aperture of the choke valve 255 and the corresponding application of surface backpressure. The choke aperture of the choke valve 255 corresponds to an amount, typically represented as a percentage, that the choke valve 255 is open. For example, a choke position of 0% indicates the choke is fully closed and a choke position of 100% indicates the choke is fully opened with intermediate settings, either discrete or continuous, referring to some degree of openness. If the driller wishes to increase wellbore pressure, the choke aperture of the choke valve 255 may be reduced to further restrict fluid flow and apply additional surface backpressure. Similarly, if the driller wishes to decrease wellbore 215 pressure, the choke aperture of the choke valve 255 may be increased to increase fluid flow and reduce the amount of applied surface backpressure. As such, the driller typically manages wellbore pressure by manipulating the choke aperture of choke valve 255 based merely on pressure sensor 275*a* reading. Similarly, the driller typically monitors return flow rate, vis-à-vis flow rate through choke 255, by measuring flow with flow meter 250 comparing the return flow rate value measured to the known mud injection rate as measured at the primary fluid pumping system. The driller may determine that a kick has occurred if flow out of the well is greater than flow into the well or the driller may determine that a loss has occurred if the flow out of the well is less than flow into the well.

While conducting operations through monitoring and controlling discrete devices has proven effective, it lacks precision, ignores meaningful drilling feedback and other information, and tends to result in increased capital costs and operating costs for overbuilt MPD systems that provide unnecessary redundancy or functionality. In addition, choke valves are prone to erode and tend to fail over time such that reliance on a correlation between a commanded choke valve position and expected choke aperture and its effect on wellbore pressure is unreliable at best and extremely dangerous at worst. While an astute driller actively monitoring or managing operations may recognize that a commanded choke valve position is not achieving the desired wellbore pressure, the delay in recognizing and taking corrective measures, which may or may not be intuitive, may result in a dangerous kick of unknown fluids, potentially including explosive gases, into the wellbore (or marine riser for offshore applications) or potentially fracture the formation resulting in the loss of expensive drilling fluids. As such, there is a long felt, but unsolved, need in the industry for an improved closed-loop hydraulic drilling system and method to more precisely manage wellbore pressure and enable condition monitoring of critically important components of the system.

Accordingly, in one or more embodiments of the present invention, an improved closed-loop hydraulic drilling system and method thereof generates one or more choke characteristic ($C_v$) curves or corresponding data thereof that more accurately reflects the relationship between the commanded choke valve position ($\%_{choke}$), and the resulting pressure drop across the choke valve for a given flow rate and fluid density. Specifically, one or more choke characteristic ($C_v$) curves may be generated through a calibration procedure and then used during non-calibration operations to more accurately monitor return flow and manage wellbore pressure by generating a set of choke performance curves from the generated choke characteristic ($C_v$) curves and the relationship between fluid specific gravity (SG), pressure drop ($\Delta P$) across the choke valve, and commanded choke valve position ($\%_{choke}$). The specific gravity (SG) of an injected calibration fluid and pressure drop ($\Delta P$) across the choke valve may be determined and correlated to the current choke valve position ($\%_{choke}$) to reflect the choke characteristic (Cv) curve in situ, thereby providing for more precise control of wellbore pressure and enabling condition monitoring of the choke valve. Using the more accurate and recent choke characteristic (Cv) curve, the driller may also determine if the return flow rate matches expectations based on the known fluid specific gravity (SG), measured pressure drop ($\Delta P$) across the choke valve, and known choke valve position ($\%_{choke}$) without using a secondary flow measurement device. Advantageously, when the driller wishes to achieve a desired wellbore pressure, a choke valve position ($\%_{choke}$) setting may be commanded, either manually or automatically, that more accurately achieves the desired wellbore pressure in less time than trial and error-based targeting methods. In addition, in certain embodiments, an improved closed-loop hydraulic drilling system does not require a flow meter, enabling the adoption of MPD systems in low-specification and economically constrained applications.

In one or more embodiments of the present invention, the volumetric flow rate (Q), choke characteristic ($C_v$) value, mud specific gravity (SG), and pressure across the choke ($\Delta P$) are recognized as interrelated variables. The choke characteristic ($C_v$) curve may be described as a continuous set of choke characteristic ($C_v$) values which correlate to the choke valve position ($\%_{choke}$) and which is valid in at least one direction of travel. The mud specific gravity (SG) describes the mud density ($\rho$) in a unitless form. The volumetric flow rate (Q) may be calculated as a function of the choke characteristic ($C_v$) value associated with the current choke valve position ($\%_{choke}$), mud specific gravity (SG), and pressure across the choke ($\Delta P$). In high specification systems, the calculated volumetric flow rate (Q) may be considered a secondary variable. However, in low specification systems, the calculated volumetric flow rate (Q) may be considered a primary variable.

In one or more embodiments of the present invention, the relationship between the volumetric flow rate (Q), choke characteristic ($C_v$) value associated with the current choke valve position ($\%_{choke}$), mud specific gravity (SG), and pressure drop across the choke ($\Delta P$) may be described by a choke performance curve. The choke characteristic ($C_v$) value associated with the current choke valve position ($\%_{choke}$) provides a measure of proportion to the relationship between the interrelated variables as represented in Equation 1:

$$C_v = Q\sqrt{\frac{SG}{\Delta P}} \tag{1}$$

Where ($C_v$) is the choke characteristic value associated with the current choke position, (Q) is the volumetric flow rate, ($\Delta P$) is the pressure across the choke, and (SG) is the specific gravity. One of ordinary skill in the art will recognize that the specific gravity (SG) represents the mud density ($\rho$) in unitless form where ($\rho \propto SG$). In one or more embodiments of the present invention, the pressure across the choke ($\Delta P$) may be obtained with one or more pressure sensors disposed on opposing sides of the choke valve. The fluid properties, while typically known, may be measured with a flow meter as discussed in more detail herein. Manufacturers of choke valves typically provide a set of static choke characteristic ($C_v$) values for a choke valve. However, the choke characteristic ($C_v$) values vary over the lifecycle of the choke valve due to erosion affecting the relationship between choke aperture and choke position. When no erosion of the choke is occurring, the choke characteristic ($C_v$) curve is typically constant. A modified form of Equation 1 may be represented as set forth in Equation 2:

$$\Delta P = SG\frac{Q^2}{C_v^2}. \tag{2}$$

Another modified form of Equation 1 may be represented as set forth in Equation 3:

$$Q = C_v\frac{\sqrt{\Delta P}}{\sqrt{SG}}. \tag{3}$$

In one or more embodiments of the present invention, using a calibration pump, the choke characteristic ($C_V$) curve may be adjusted for fluid at known flow rate (Q), specific gravity (SG), and choke pressure drop ($\Delta P$) values. One or more samples may be taken continuously or intermittently and recorded by a data acquisition and control system.

In one or more embodiments of the present invention, an improved closed-loop drilling system for drilling a subterranean wellbore in onshore, shallow water, or offshore applications is described. However, application-specific aspects, that are well known to one of ordinary skill in the art, are purposefully not described to avoid obscuring the description of the present invention. Notwithstanding, in the description that follows, in onshore or shallow water applications the BOP (not shown) may be disposed over, and in fluid communication with, a wellhead (not shown) disposed above, and in fluid communication with, a wellbore (not shown). Alternatively, in offshore, including deepwater, applications, the BOP (not shown) may be a SSBOP disposed on or near the subsea surface (not shown) and in fluid communication with a wellhead (not shown) disposed over, and in fluid communication with, a subsea wellbore (not shown). The BOP (not shown) may be, for example, disposed below, and in fluid communication with, a marine riser system (not shown) that fluidly communicates with aspects of the MPD system (not shown). One of ordinary skill in the art will recognize that that following description, while applicable to onshore, shallow water, and offshore applications, will be focused on aspects of the improved closed-loop hydraulic drilling system that are applicable in all such applications.

Figure 3:
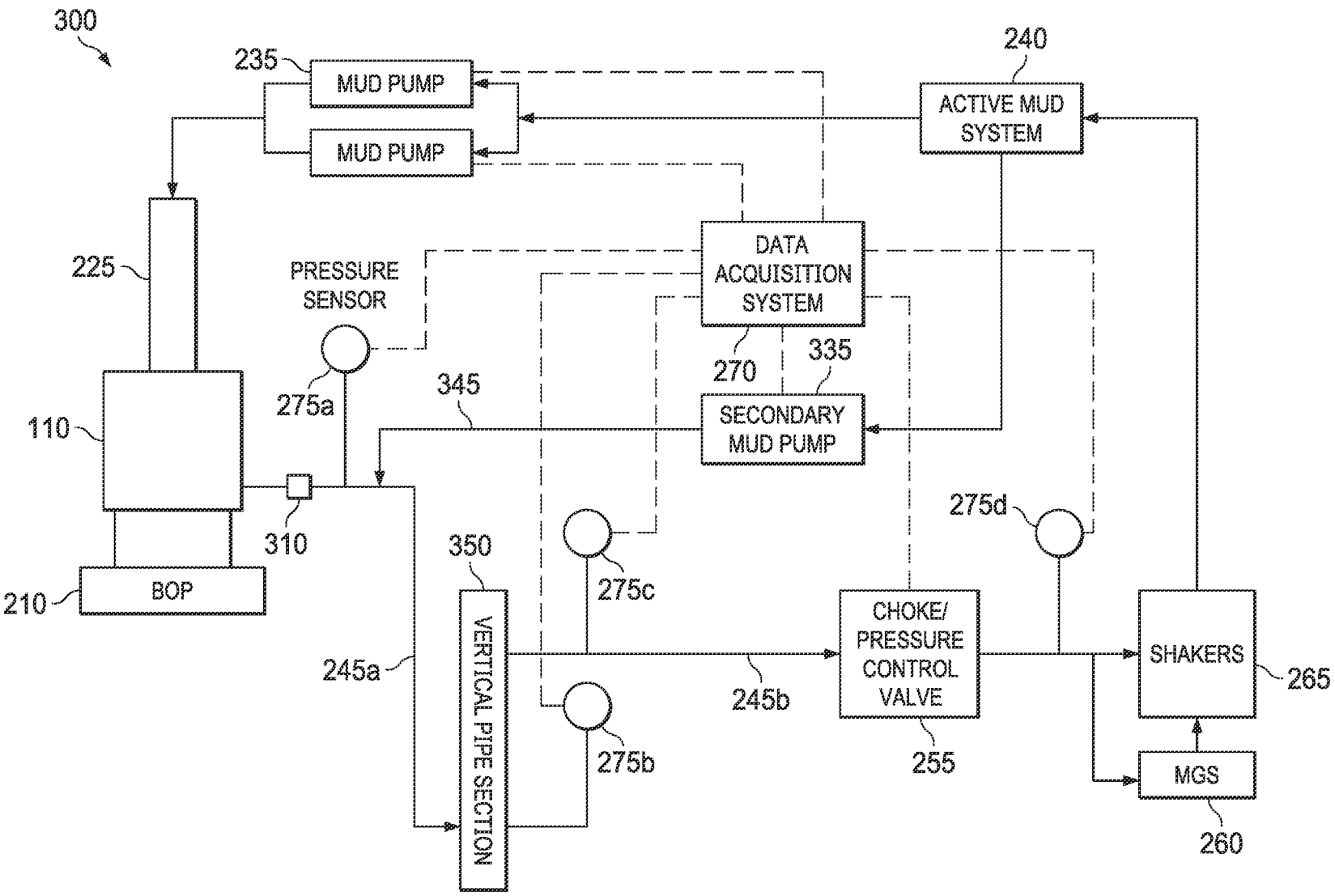
FIG. 3 shows an improved closed-loop drilling system in accordance with one or more embodiments of the present invention.

FIG. 3 shows an improved closed-loop drilling system 300 for drilling a subterranean wellbore (not shown) in an onshore, shallow water, or offshore application in accordance with one or more embodiments of the present invention. In certain embodiments, improved closed-loop drilling system 300 does not require the use of a flow meter and may use a poor man's density meter (275*b*, 350, and 275*c*) as discussed herein to reduce cost and enable the adoption of MPD in low-specification applications. System 300 may include an annular sealing system 110, or equivalent thereof, that seals the annulus (not shown) surrounding drill string 225. A primary fluid pumping system, such as, for example, one or more mud pumps 235, may inject drilling fluids (not shown) from an active mud system 240, into the wellbore (not shown) through drill string 225 to a bottomhole assembly or drill bit (not shown) during normal operations. A side return port (not shown), or equivalent thereof, disposed below the annular seal, may divert returning fluids from the annulus (not shown) to choke valve 255 via fluid return lines 245*a*, 245*b*. The flow rate (not shown) of returning fluids (not shown) may be controlled by the choke aperture, $f(\%_{choke})$, setting of choke valve 255. Choke valve 255 controllably directs returning fluids to mud-gas-separator 260 and/or shale shaker 265 or other fluids processing system prior to returning fluids to active mud system 240. Similar to conventional closed-loop drilling systems, data acquisition and control system 270 may manually or automatically manage wellbore pressure by manipulating a commanded choke aperture, $f(\%_{choke})$, setting of choke valve 255 based off sensed pressure 275 readings.

In one or more embodiments of the present invention, during calibration operations, primary fluid pumping system 235 may be stopped. A wellbore isolation valve 310 may controllably isolate fluid return line 245*a* from the annulus (not shown). While wellbore isolation valve 310 may be disposed close to the wellbore (not shown), it may be disposed elsewhere along fluid return line 245. System 300 may also include a secondary fluid pumping system 335 that controllably injects calibration fluids (not shown) into fluid return line 245*a*, on the side that remains in fluid communication with choke valve 255, that are directed towards choke valve 255 during calibration. In certain embodiments, secondary fluid pumping system 335 may be a positive displacement pump system. A poor man's density meter 350 may be disposed in line with fluid return lines 245*a* and 245*b* upstream of choke valve 255 that may provide a measurement of a fluid density or specific gravity or data thereof to data acquisition and control system 270. Data acquisition and control system 270 may acquire (in the case of a type or kind of flow meter that communicates fluid density or specific gravity directly) or calculate fluid density or specific gravity of the injected calibration fluids (not shown) based off of measurements and the pressure drop across poor man's density meter 350 when secondary fluid pumping system 335 is engaged.

In certain embodiments, such as the one depicted in FIG. 3, a substantially vertical portion or a substantially vertical device 350, in line with fluid return lines 245*a* and 245*b*, may be used in conjunction with pressure sensors 275*b* and 275*c* to measure and calculate the fluid density or specific gravity of injected fluids (not shown) passing therethrough in an inexpensive and economical manner. For example, the data acquisition system 270 may determine the fluid density, in pounds per gallon, by dividing the pressure differential measured across the substantially vertical portion or device 350 (by subtracting pressure measured by sensor 275*d* from that measured by sensor 275*c*) by the quantity that is calculated by multiplying the height of the substantially vertical portion or device 350 with a factor of 0.052 or a similar conversion factor with consistent units. Additionally, data acquisition and control system 270 may convert a fluid density, in units of pounds per gallon, to a specific gravity, a dimensionless quantity, by dividing the fluid density by the fluid density of a known reference, typically water, in the same units. In other embodiments, poor man's density meter 350 may be a density meter (not shown). In still other embodiments, poor man's density meter 350 may be input from a mud logger system (not shown). In still other embodiments, poor man's density meter 350 may be a Coriolis meter (not shown). In still other embodiments, poor man's density meter 350 may be a wedge flow meter (not shown). In still other embodiments, poor man's density meter 350 may be a positive displacement flow meter (not shown). In still other embodiments, poor man's density meter 350 may be removed and data acquisition and control system 270 may operate off rig assumptions. One of ordinary skill in the art will recognize that flow meter 350 may be any suitable meter capable of measuring, sensing, or providing fluid density or specific gravity of injected fluids flowing therethrough in accordance with one or more embodiments of the present invention.

System 300 may include a plurality of pressure sensors 275 to measure hydrostatic pressure at various points within system 300. For example, a first pressure sensor 275*c* may be disposed upstream of choke valve 255 that provides a measurement of upstream pressure to data acquisition and control system 270. A second pressure sensor 275*d* may be disposed downstream of choke valve 255 that provides a measurement of downstream pressure to data acquisition and control system 270. Data acquisition and control system 270 may generate a choke characteristic ($C_V$) curve or data thereof by stopping the primary fluid pumping system 235, closing wellbore isolation valve 310, engaging secondary fluid pumping system 335 to inject calibration fluids (not shown) into fluid return line 245*a*, varying a commanded choke aperture, $f(\%_{choke})$, setting of choke valve 255 through a plurality of set points, and recording a pressure differential across choke valve 255. After calibration, data acquisition and control system 270 may the control the commanded choke position ($\%_{choke}$) setting to affect the choke aperture of choke valve 255 according to the choke characteristic ($C_V$) curve or data thereof, thereby more accurately achieving a desired pressure.

One of ordinary skill in the art will recognize that data acquisition and control system 270 may acquire, measure, calculate, and/or control other data as part of a manual or automated MPD system including, but not limited to, an injection flow rate of the injected drilling fluids into drill string 225, the injection flow rate of the injected calibration fluids into the fluid return line 245, and other acquired, measured, or calculated data generated from one or more sensors based on an application and design.

Figure 4:
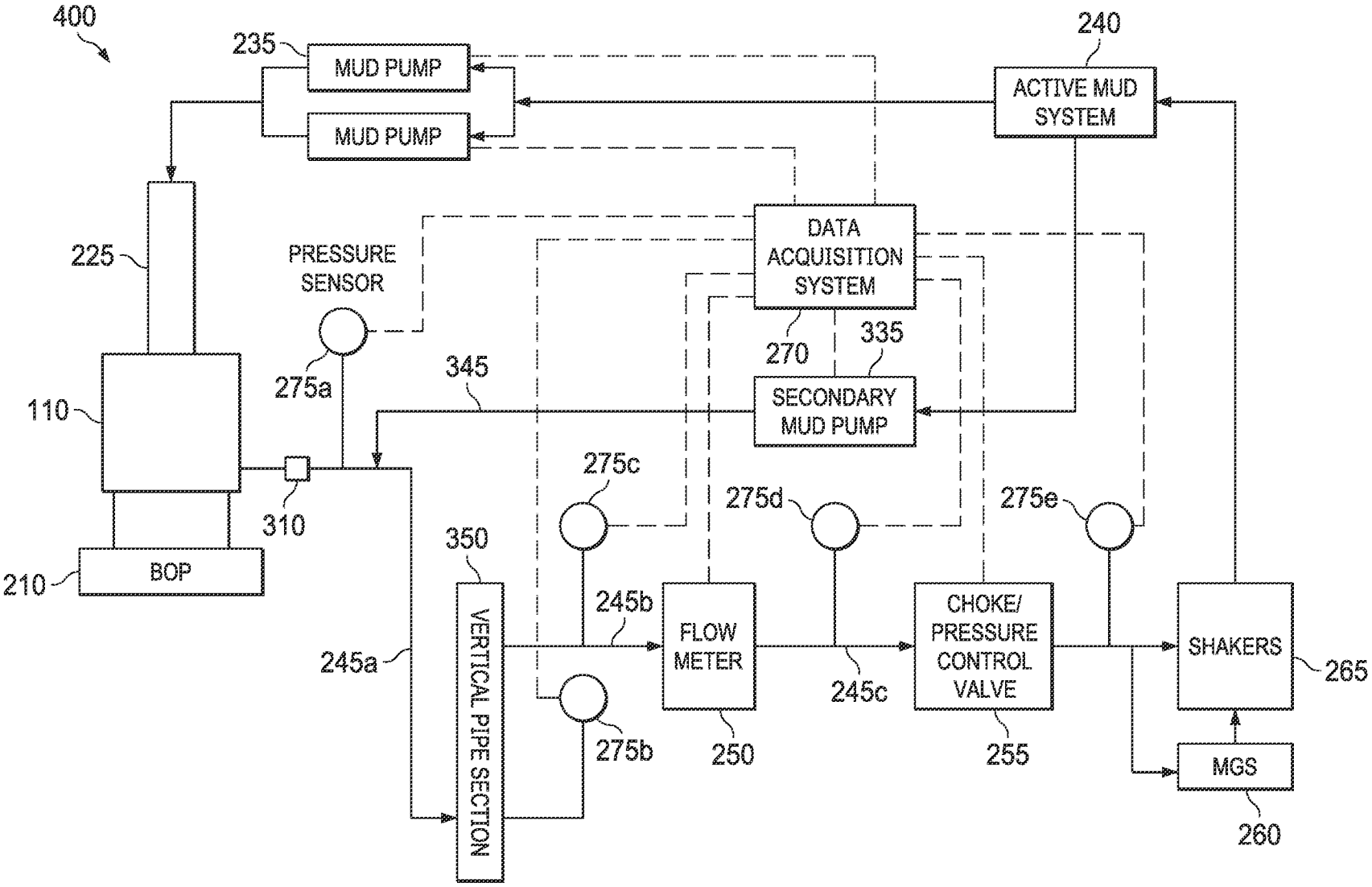
FIG. 4 shows an improved closed-loop drilling system in accordance with one or more embodiments of the present invention.

FIG. 4 shows an improved closed-loop drilling system 400 for drilling a subterranean wellbore (not shown) in an onshore, shallow water, or offshore application in accordance with one or more embodiments of the present invention. The improved closed-loop drilling system 400 may be substantially like previously disclosed embodiments but may include a flow meter 250 disposed in between poor man's density meter 350 and choke valve 255. Because of the addition of flow meter 250, an additional sensor 275*e* is required to ensure that the pressure drop across choke valve 255 may be accurately measured. In certain embodiments, flow meter 250 may be used during normal operations and poor man's density meter 350 may be used during calibration operations to determine the fluid density or specific gravity of the injected calibration fluids. In other embodiments, poor man's density meter 350 may be used during normal operations and flow meter 250 may be used during calibration operations to determine the fluid density or specific gravity of the injected calibration fluids. In still other embodiments, both flow meter 250 and poor man's density meter 350 may be used redundantly to determine the fluid density or specific gravity of the injected calibration fluids. When both meters 250, 350 are used, the measured values may be averaged, weighted, or otherwise mathematically manipulated to provide a more accurate measure of the fluid density or specific gravity.

Figure 5:
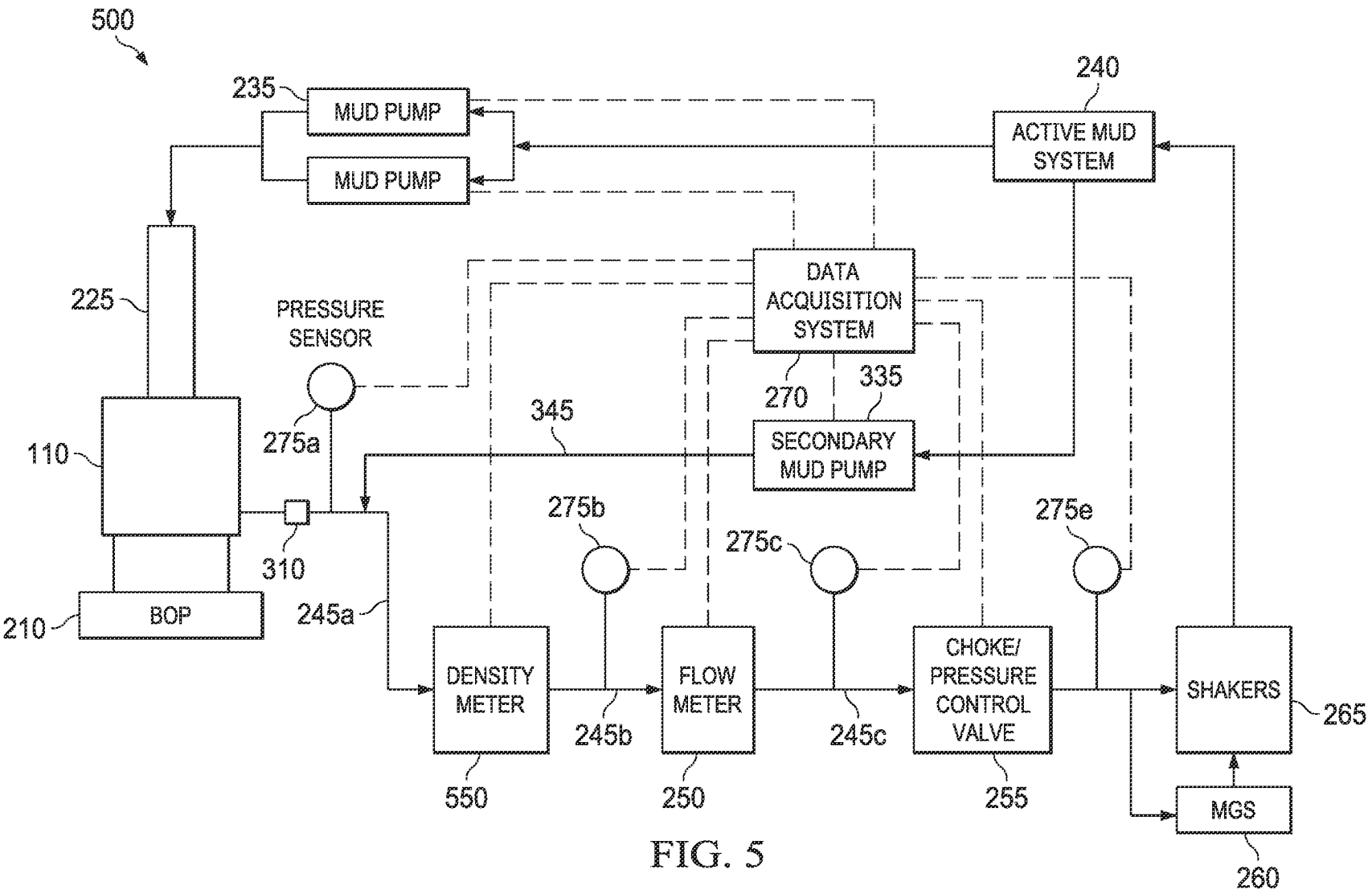
FIG. 5 shows an improved closed-loop drilling system in accordance with one or more embodiments of the present invention.

FIG. 5 shows an improved closed-loop drilling system 500 for drilling a subterranean wellbore (not shown) in an onshore, shallow water, or offshore application in accordance with one or more embodiments of the present invention. The improved closed-loop drilling system 500 may be substantially like previously disclosed embodiments, such as that embodied by FIG. 4, but may include a density meter 550 disposed upstream of flow meter 250. Density meter 550 typically provides a fluid density (ρ) in units of $kg/m^3$ or $lb/ft^3$. Data acquisition and control system 270 may calculate a specific gravity by dividing the fluid density of the injected calibration fluids by the fluid density of a known reference such as, for example, water. In certain embodiments, density meter 550 may be used during normal operations and flow meter 250 may be used during calibration operations to determine the fluid density or specific gravity of the injected calibration fluids. In other embodiments, flow meter 250 may be used during normal operations and density meter 550 may be used during calibration operations to determine the fluid density or specific gravity of the injected calibration fluids. In still other embodiments, both flow meter 250 and density meter 550 may be used redundantly to determine the fluid density or specific gravity of the injected calibration fluids. When both meters 250, 550 are used, the measured values may be averaged, weighted, or otherwise mathematically manipulated to provide a more accurate measure of the fluid density or specific gravity.

Figure 6:
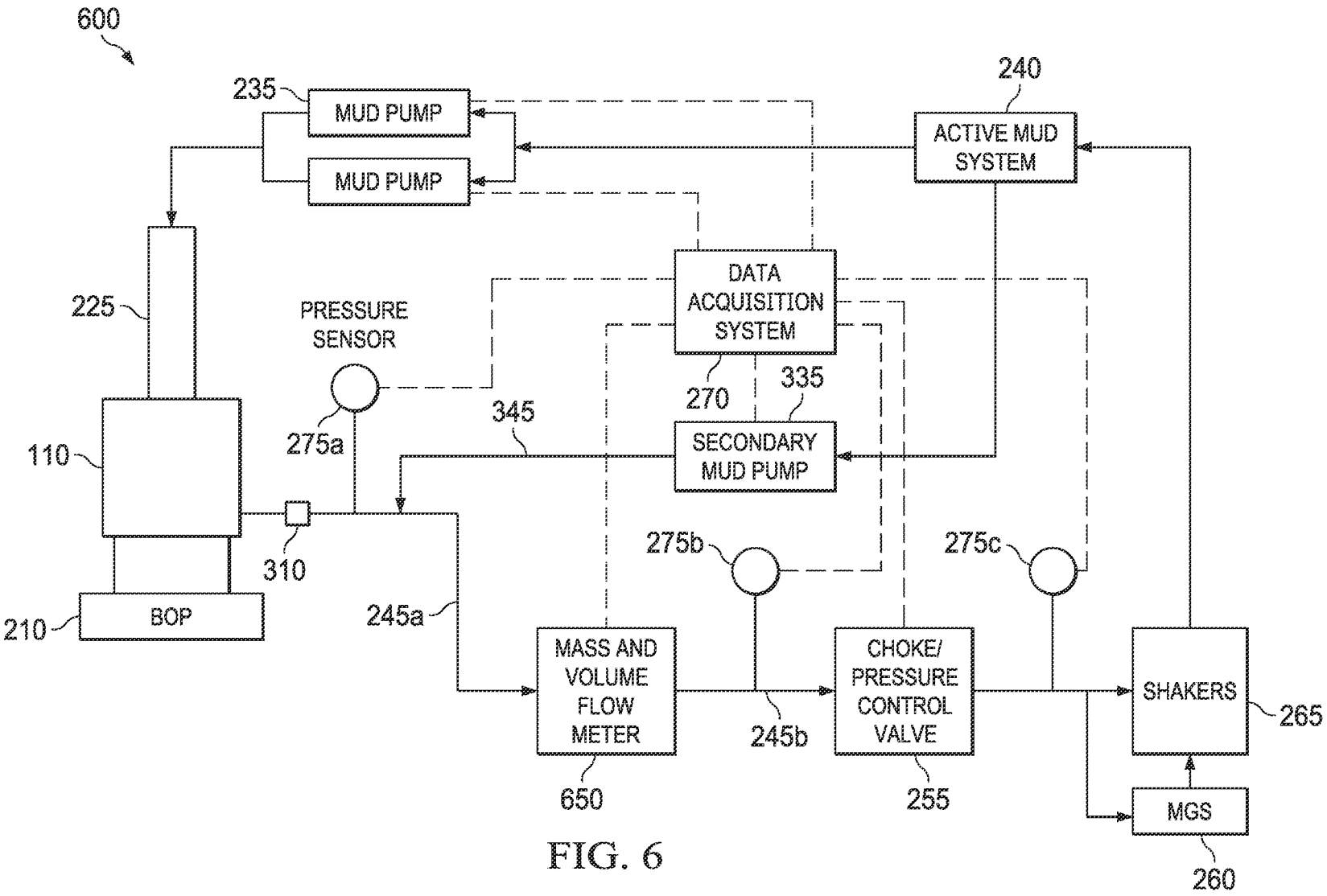
FIG. 6 shows an improved closed-loop drilling system in accordance with one or more embodiments of the present invention.

FIG. 6 shows an improved closed-loop drilling system 600 for drilling a subterranean wellbore (not shown) in an onshore, shallow water, or offshore application in accordance with one or more embodiments of the present invention. The improved closed-loop drilling system 600 may be substantially similar to previously disclosed embodiments, such as, for example that embodied by FIG. 3, but may include a mass and volume flow meter 650, such as a Coriolis meter, instead of flow meter 250 or poor man's density meter 350 that is disposed upstream choke valve 255. Data acquisition and control system 270 may calculate the fluid density or specific gravity based on the measured data received from mass and volume flow meter 650.

Figure 7:
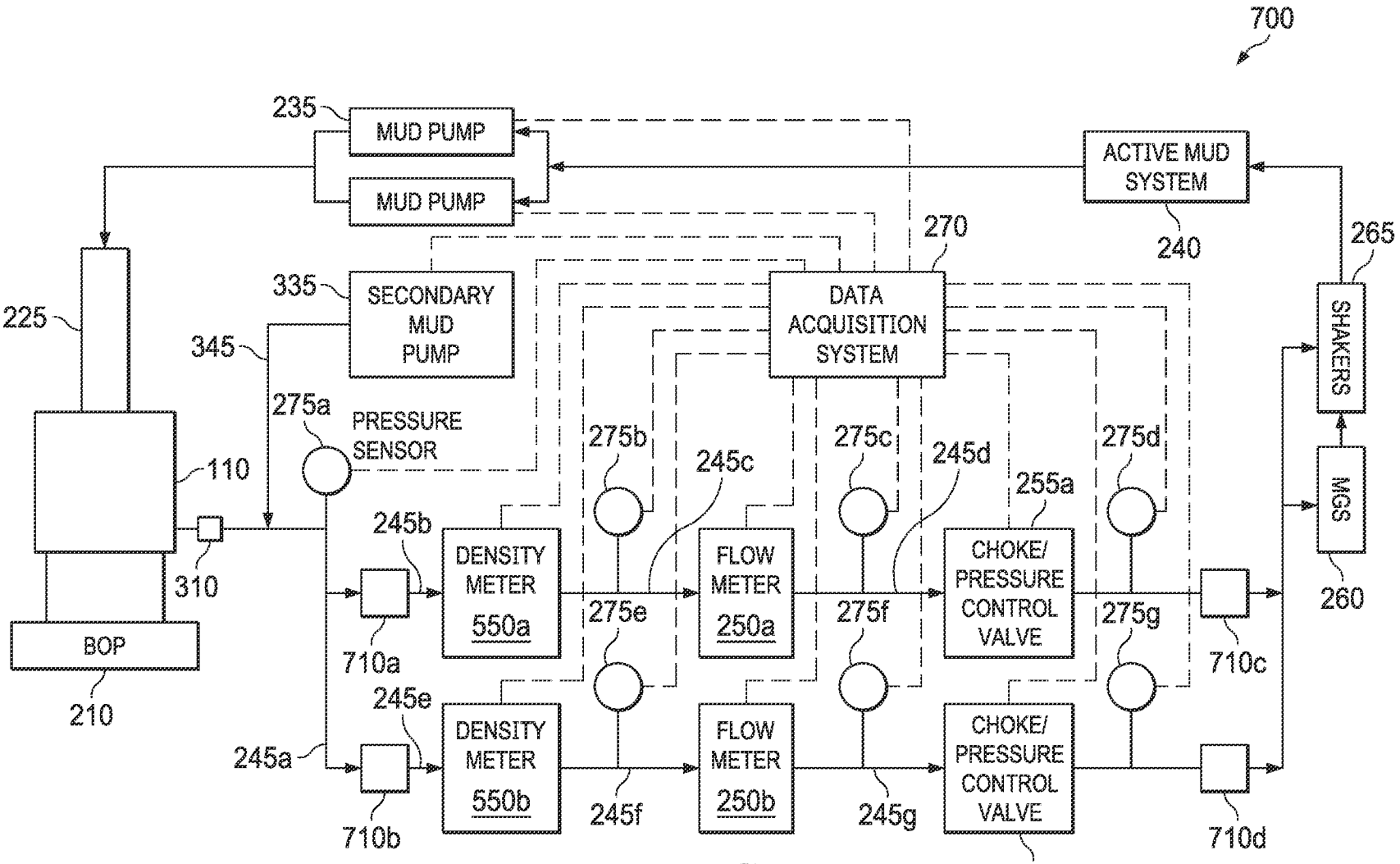
FIG. 7 shows an improved closed-loop drilling system in accordance with one or more embodiments of the present invention.

FIG. 7 shows an improved closed-loop drilling system 700 for drilling a subterranean wellbore (not shown) in an onshore, shallow water, or offshore application in accordance with one or more embodiments of the present invention. The improved closed-loop drilling system 700 may be substantially like previously disclosed embodiments, such as, for example, that embodied by FIG. 5, but may include two parallel fluid return line paths that feed into fluids processing systems 260 and 265. A first fluid return line path may include density meter 550*a*, flow meter 250*a*, and choke valve 255*a*, whereas a second fluid return line path may include density meter 550*b*, flow meter 250*b*, and choke valve 255*b*. In certain embodiments, one of the fluid return line paths may be used during normal operations and the other may be used during calibration operations. In other embodiments, both fluid return line paths may be used during normal operations and during calibration operations. In still other embodiments, both fluid return line paths may be used for normal operations and one fluid return line path may be used for calibration operations. In still other embodiments, one fluid return line path may be used for normal operations, and both fluid return line paths may be used for calibration operations.

Figure 8:
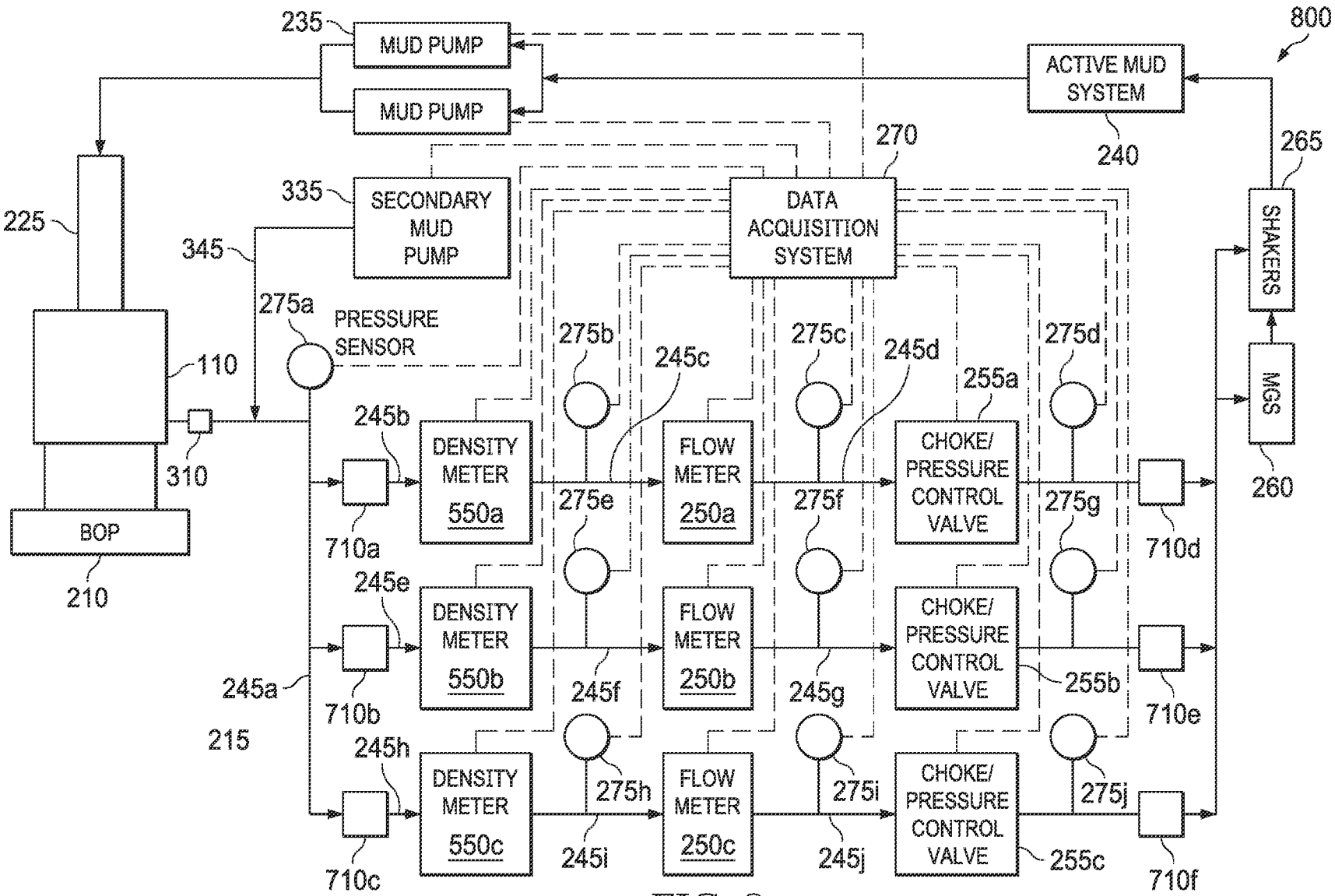
FIG. 8 shows an improved closed-loop drilling system in accordance with one or more embodiments of the present invention.

FIG. 8 shows an improved closed-loop drilling system 800 for drilling a subterranean wellbore (not shown) in an onshore, shallow water, or offshore application in accordance with one or more embodiments of the present invention. The improved closed-loop drilling system 800 is substantially like previously disclosed embodiments, such as, for example, that embodied by FIG. 5 and FIG. 7, but may include three parallel fluid return line path that feeds into fluids processing systems 260 and 265. A first fluid return line path may include density meter 550*a*, flow meter 250*a*, and choke valve 255*a*, a second fluid return line path may include density meter 550*b*, flow meter 250*b*, and choke valve 255*b*, and a third fluid return line path may include density meter 550*c*, flow meter 250*c*, and choke valve 255*c*. In one or more embodiments of the present invention, one, two, or three fluid return line paths may be used for normal operations and one, two, or three fluid return line paths may be used during calibration operations, including all combinations and permutations.

While the above-noted embodiments are exemplary, one of ordinary skill in the art will recognize that any configuration that allows for measurement of fluid density or specific gravity of the injected calibration fluids and measurement of the pressure drop across the choke valve may be used in accordance with one or more embodiments of the present invention.

In each embodiment, the annulus surrounding the drill string is sealed with an annular sealing system. A fluid return line, attached to a side return port disposed below the annular seal, is isolated from the annulus with a wellbore isolation valve. During calibration operations, the primary fluid pumping system is stopped, and calibration fluids are injected from a secondary fluid pumping system into the fluid return line towards a choke valve. A flow or density meter, regardless of the type of kind, disposed in line with the fluid return line upstream of the choke valve, may be used to determine a fluid density or specific gravity of the injected calibration fluids. A first pressure upstream of the choke valve may be determined by a first pressure sensor disposed upstream of the choke valve. A second pressure downstream of the choke valve may be determined by a second pressure sensor disposed downstream of the choke valve. A data acquisition and control system may vary a commanded choke aperture of the choke valve through a plurality of set points and record a pressure drop across the choke valve at each of the set points. One or more improved choke characteristic curves, or data thereof, may be generated showing the commanded choke aperture setting and the corresponding pressure drop across the choke valve for a given fluid density and injection flow rate of the calibration fluids. A choke performance curve may be generated from the generated choke characteristic ($C_v$) curves and the relationship between fluid specific gravity (SG), pressure drop ($\Delta P$) across the choke valve, and commanded choke position ($\%_{choke}$). During normal operations, the choke valve may be operated according to the choke characteristic curves or choke performance curve to more accurately achieve a desired pressure with the calibrated choke valve.

Figure 9A:
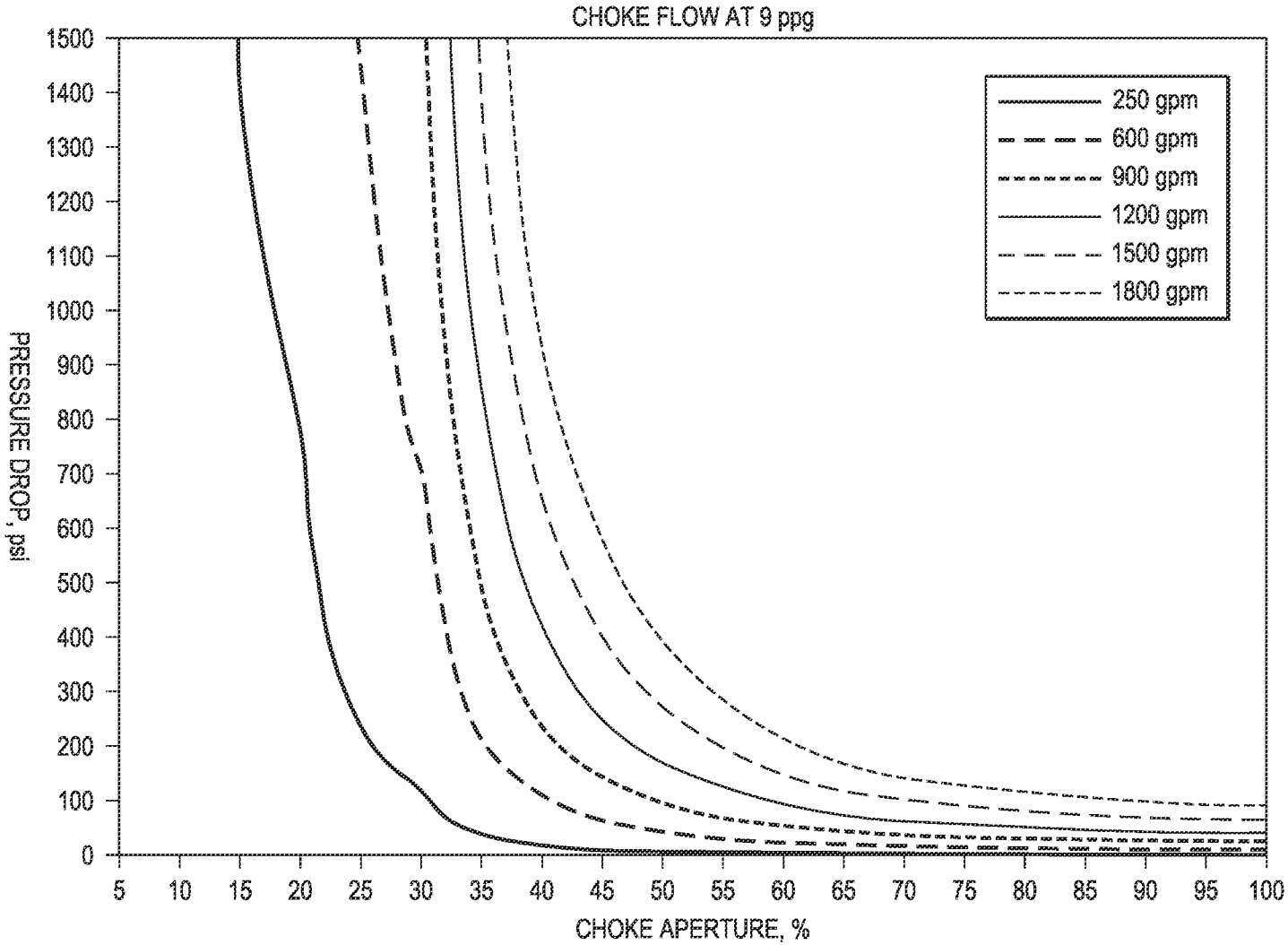
FIG. 9A shows an exemplar choke characteristic curve generated in accordance with one or more embodiments of the present invention.

FIG. 9A shows an exemplar choke performance curve generated in accordance with one or more embodiments of the present invention. In certain embodiments, a choke performance curve may be generated for a fixed or predetermined fluid density, such as, for example, 9 pounds per gallon in the exemplar depicted. In such a case, a plurality of choke performance curves may be generated for various injection flow rates, where each curve includes a plot of commanded choke position setting and pressure drop across the choke valve for a specific flow rate. During normal operations, if drilling fluids having a fluid density of 9 pounds per gallon is being used, the driller (in manual systems) and the data acquisition and control system (in automated systems) may use the appropriate curve for the injection flow rate and determine the appropriate commanded choke position setting to use to achieve the desired pressure drop across the choke valve. One of ordinary skill in the art will recognize other systems and software may be used to model or predict the appropriate pressure for a given contingency, such that the data acquisition and control system simply has to identify from the curve or data thereof the appropriate choke position setting to achieve it. While the visual depiction of the data contained in the choke characteristic curves is helpful to understanding, one of ordinary skill in the art will recognize that generating a curve may not be necessary as the data acquisition and control system may process the data thereof through one or more data structures more suitable for such use.

Figure 9B:
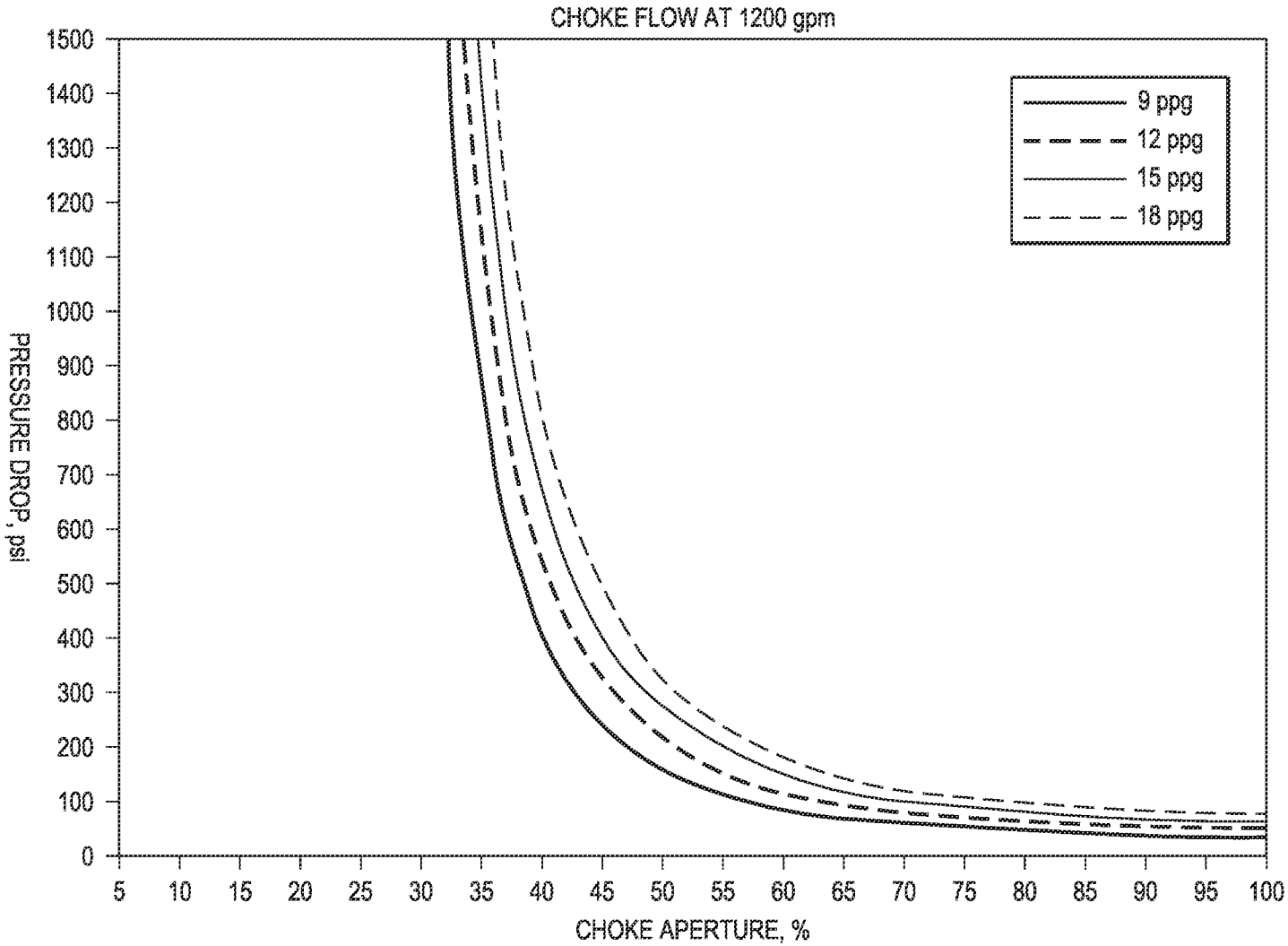
FIG. 9B shows an exemplar choke characteristic curve generated in accordance with one or more embodiments of the present invention.

FIG. 9B shows an exemplar choke performance curve generated in accordance with one or more embodiments of the present invention. In certain embodiments, a choke performance curve may be generated for a fixed or predetermined injection flow rate, such as, for example, 1200 gallons per minute in the exemplar depicted. In such a case, a plurality of choke performance curves may be generated for various fluid densities, where each curve includes a plot of commanded choke position setting and pressure drop across the choke valve. During normal operations, if drilling fluids are injected at an injection flow rate of 1200 gallons per minute, the driller (in manual systems) and the data acquisition and control system (in automated systems) may use the appropriate curve for the fluid density being used and determine the appropriate commanded choke aperture to use to achieve the desired pressure drop across the choke valve. One of ordinary skill in the art will recognize other systems and software may be used to model or predict the appropriate pressure for a given contingency, such that the data acquisition and control system simply has to identify from the curve or data thereof the appropriate choke aperture setting to achieve it. While the visual depiction of the data contained in the choke characteristic curve is helpful to understanding, one of ordinary skill in the art will recognize that generating a curve may not be necessary as the data acquisition and control system may process the data thereof through one or more data structures more suitable for such use.

Figure 10A:
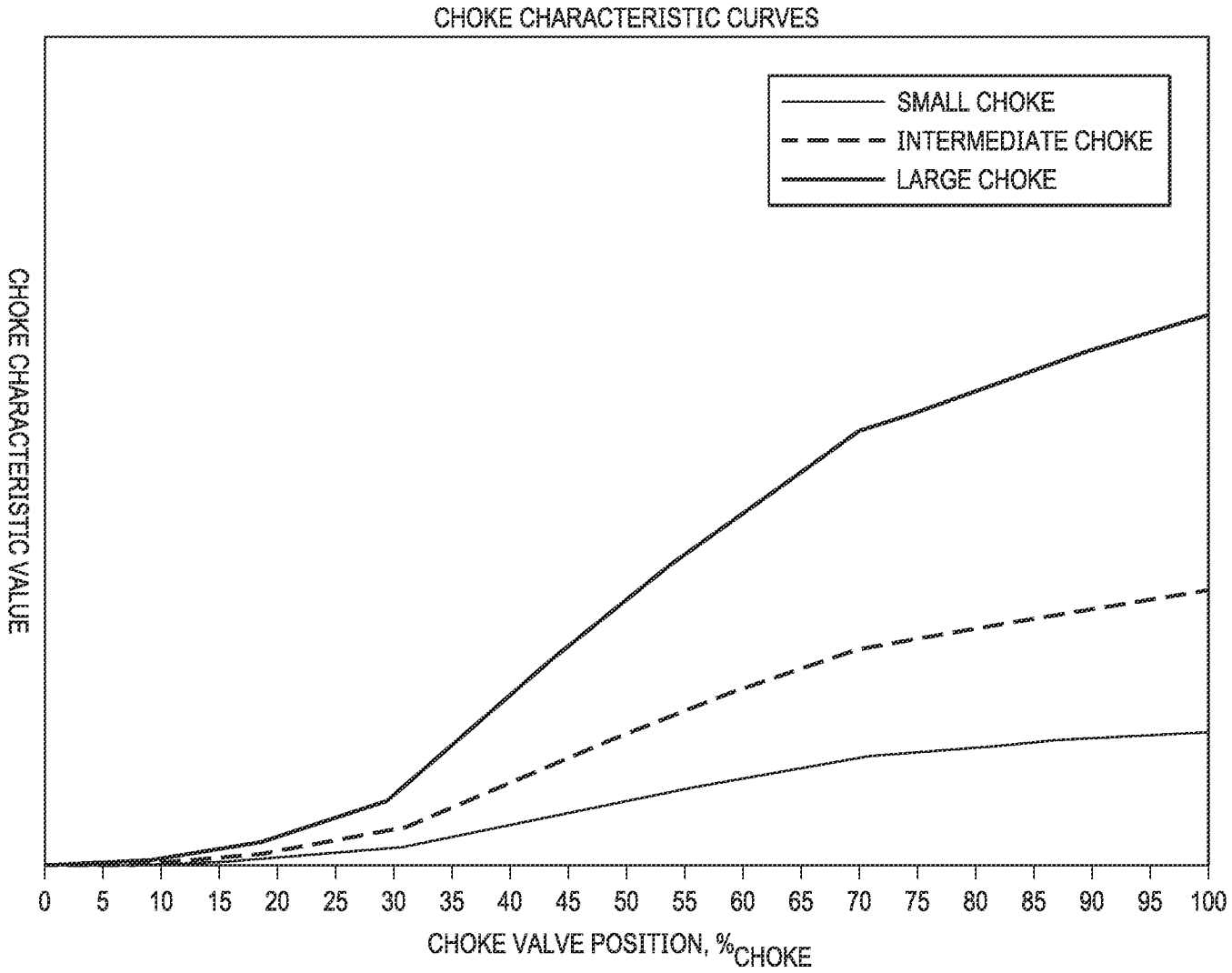
FIG. 10A shows an exemplar choke performance curve generated in accordance with one or more embodiments of the present invention.

FIG. 10A shows an exemplar choke characteristic ($C_v$) curve generated in accordance with one or more embodiments of the present invention. In certain embodiments, after the choke performance curves or data thereof have been generated, a choke characteristic ($C_v$) curve may be generated. The choke characteristic ($C_v$) curve may be a plot of choke characteristic values and choke valve position, for small, intermediate, and large size chokes. As such, rather than relying on a static set of $C_v$ values, that may not be applicable due to a worn state of a choke valve, the driller or data acquisition and control system may use the choke performance curve, or data thereof, to identify the actual $C_v$ value for a given choke valve position. Advantageously, the more accurate version of the Cv may be used to detect the occurrence of choke erosion or plugging and enable choke condition monitoring. While the visual depiction of the data contained in the choke characteristic curves is helpful to understanding, one of ordinary skill in the art will recognize that generating a curve may not be necessary as the data acquisition and control system may process the data thereof through one or more data structures more suitable for such use.

Figure 10B:
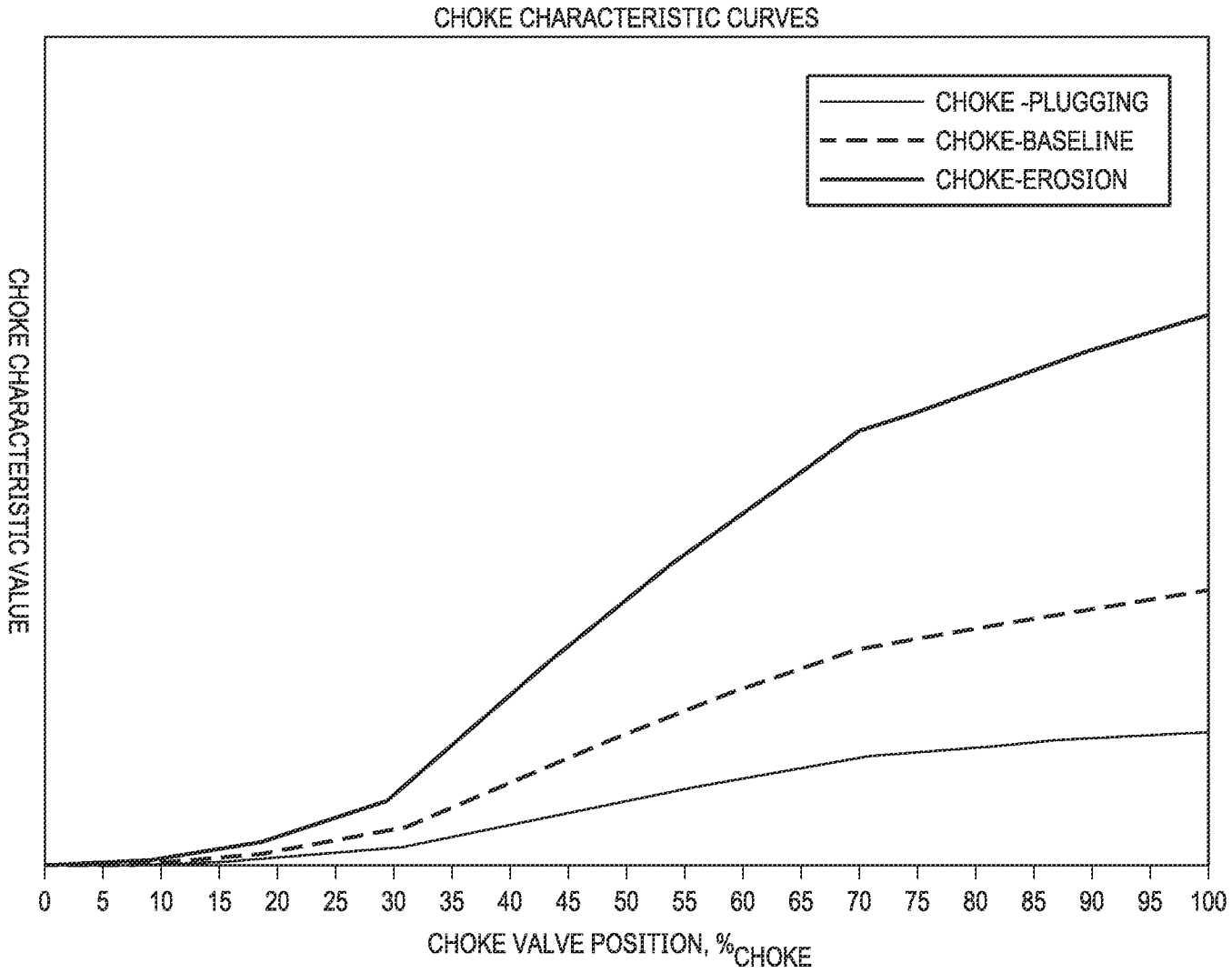
FIG. 10B shows an exemplar choke performance curve generated in accordance with one or more embodiments of the present invention.

FIG. 10B shows an exemplar choke performance curve generated in accordance with one or more embodiments of the present invention. In certain embodiments, after the choke performance curves or data thereof have been generated, a choke characteristic ($C_v$) curve may be generated. The choke characteristic ($C_v$) curve may be a plot of choke characteristic values and choke valve position as a function of time over the lifecycle of the choke. As such, rather than relying on a static set of $C_v$ values, that may not be applicable due to a worn state of a choke valve, the driller or data acquisition and control system may use the choke performance curve, or data thereof, to identify the actual $C_v$ value for a given choke valve position in time. Advantageously, the more accurate version of the Cv may be used to detect the occurrence of choke erosion or plugging and enable choke condition monitoring. While the visual depiction of the data contained in the choke characteristic curves is helpful to understanding, one of ordinary skill in the art will recognize that generating a curve may not be necessary as the data acquisition and control system may process the data thereof through one or more data structures more suitable for such use.

Figure 11:
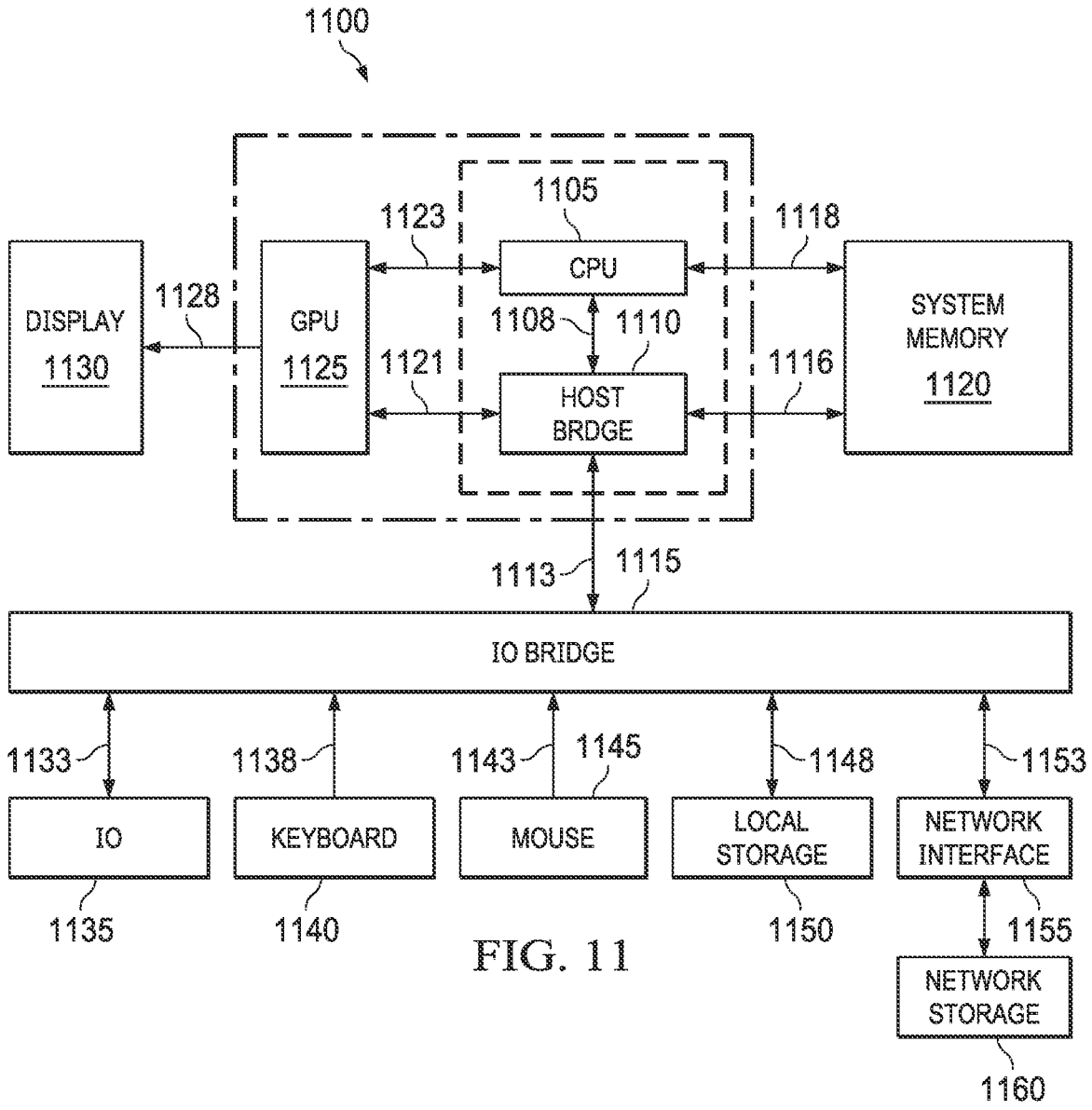
FIG. 11 shows a data acquisition and control system in accordance with one or more embodiments of the present invention.

FIG. 11 shows a data acquisition and control system 1100 in accordance with one or more embodiments of the present invention. Data acquisition and control system 1100 may include one or more central processing units (singular "CPU" or plural "CPUs") 1105, host bridge 1110, input/output ("IO") bridge 1115, graphics processing units (singular "GPU" or plural "GPUs") 1125, and/or application-specific integrated circuits (singular "ASIC or plural "ASICs") (not shown) disposed on one or more printed circuit boards (not shown) that perform computational operations. Each of the one or more CPUs 1105, GPUs 1125, or ASICs (not shown) may be a single-core (not independently illustrated) device or a multi-core (not independently illustrated) device. Multi-core devices typically include a plurality of cores (not shown) disposed on the same physical die (not shown) or a plurality of cores (not shown) disposed on multiple die (not shown) that are collectively disposed within the same mechanical package (not shown).

CPU 1105 may be a general-purpose computational device typically configured to execute software instructions. CPU 1105 may include an interface 1108 to host bridge 1110, an interface 1118 to system memory 1120, and an interface 1123 to one or more 10 devices, such as, for example, one or more GPUs 1125. GPU 1125 may serve as a specialized computational device typically configured to perform graphics functions related to frame buffer manipulation. However, one of ordinary skill in the art will recognize that GPU 1125 may be used to perform non-graphics related functions that are computationally intensive. In certain embodiments, GPU 1125 may interface 1123 directly with CPU 1125 (and interface 1118 with system memory 1120 through CPU 1105). In other embodiments, GPU 1125 may interface 1121 with host bridge 1110 (and interface 1116 or 1118 with system memory 1120 through host bridge 1110 or CPU 1105 depending on the application or design). In still other embodiments, GPU 1125 may interface 1133 with IO bridge 1115 (and interface 1116 or 1118 with system memory 1120 through host bridge 1110 or CPU 1105 depending on the application or design). The functionality of GPU 1125 may be integrated, in whole or in part, with CPU 1105.

Host bridge 1110 may be an interface device that interfaces between the one or more computational devices and IO bridge 1115 and, in some embodiments, system memory 1120. Host bridge 1110 may include an interface 1108 to CPU 1105, an interface 1113 to IO bridge 1115, for embodiments where CPU 1105 does not include an interface 1118 to system memory 1120, an interface 1116 to system memory 1120, and for embodiments where CPU 1005 does not include an integrated GPU 1125 or an interface 1123 to GPU 1125, an interface 1121 to GPU 1125. The functionality of host bridge 1110 may be integrated, in whole or in part, with CPU 1105. IO bridge 1115 may be an interface device that interfaces between the one or more computational devices and various IO devices (e.g., 1140, 1145) and IO expansion, or add-on, devices (not independently illustrated). IO bridge 1115 may include an interface 1113 to host bridge 1110, one or more interfaces 1133 to one or more IO expansion devices 1135, an interface 1138 to keyboard 1140, an interface 1143 to mouse 1145, an interface 1148 to one or more local storage devices 1150, and an interface 1153 to one or more network interface devices 1055. The functionality of IO bridge 1115 may be integrated, in whole or in part, with CPU 1105 or host bridge 1110. Each local storage device 1150, if any, may be a solid-state memory device, a solid-state memory device array, a hard disk drive, a hard disk drive array, or any other non-transitory computer readable medium. Network interface device 1155 may provide one or more network interfaces including any network protocol suitable to facilitate networked communications.

Data acquisition and control system 1100 may include one or more network-attached storage devices 1160 in addition to, or instead of, one or more local storage devices 1150. Each network-attached storage device 1160, if any, may be a solid-state memory device, a solid-state memory device array, a hard disk drive, a hard disk drive array, or any other non-transitory computer readable medium. Network-attached storage device 1160 may or may not be collocated with data acquisition and control system 1100 and may be accessible to data acquisition and control system 1100 via one or more network interfaces provided by one or more network interface devices 1155.

One of ordinary skill in the art will recognize that data acquisition and control system 1100 may be a conventional computing system or an application-specific computing system (not shown). In certain embodiments, an application-specific computing system (not shown) may include one or more ASICs (not shown) that perform one or more specialized functions in a more efficient manner. The one or more ASICs (not shown) may interface directly with CPU 1105, host bridge 1110, or GPU 1125 or interface through IO bridge 1115. Alternatively, in other embodiments, an application-specific computing system (not shown) may be reduced to only those components necessary to perform a desired function in an effort to reduce one or more of chip count, printed circuit board footprint, thermal design power, and power consumption. The one or more ASICs (not shown) may be used instead of one or more of CPU 1105, host bridge 1110, IO bridge 1115, or GPU 1125. In such systems, the one or more ASICs may incorporate sufficient functionality to perform certain network and computational functions in a minimal footprint with substantially fewer component devices.

As such, one of ordinary skill in the art will recognize that CPU 1105, host bridge 1110, IO bridge 1115, GPU 1125, or ASIC (not shown) or a subset, superset, or combination of functions or features thereof, may be integrated, distributed, or excluded, in whole or in part, based on an application, design, or form factor in accordance with one or more embodiments of the present invention. Thus, the description of data acquisition and control system 1100 is merely exemplary and not intended to limit the type, kind, or configuration of component devices that constitute a data acquisition and control system 1100 suitable for performing computing operations in accordance with one or more embodiments of the present invention. Notwithstanding the above, one of ordinary skill in the art will recognize that data acquisition and control system 1100 may be a standalone, laptop, desktop, industrial, server, blade, or rack mountable system and may vary based on an application or design.

Advantages of one or more embodiments of the present invention may include, but is not limited to, one or more of the following:

In one or more embodiments of the present invention, an improved closed-loop drilling system and method thereof improve the ability to manage wellbore pressure in a more accurate manner. Advantageously, the increased precision by which wellbore pressure may be managed increases the safety of operations and allows drillers to execute more complicated and challenging well plans that would otherwise be possible.

In one or more embodiments of the present invention, an improved closed-loop drilling system and method thereof allow for the calibration of a choke valve such that normal operations may be conducted with reliable and predictable results that take into consideration the current condition and state of erosion of the choke valve.

In one or more embodiments of the present invention, an improved closed-loop drilling system and method thereof the choke valve may be calibrated such that a commanded choke valve position reliably results in a corresponding pressure drop across the choke valve. During normal operations, the appropriate commanded choke valve position setting may be selected, either manually or automatically, to achieve the desired pressure.

In one or more embodiments of the present invention, an improved closed-loop drilling system and method thereof enables condition monitoring of the choke valve. As such, the performance and remaining usable of life of the choke valve may be modeled and predicted based on the variance of the commanded choke valve position and the resulting pressure drop across the choke valve from standard values.

In one or more embodiments of the present invention, an improved closed-loop drilling system and method thereof reduces operational and maintenance costs of the choke valve.

In one or more embodiments of the present invention, an improved closed-loop drilling system and method thereof reduces non-productive downtime caused by unexpectedly failing choke valves or components thereof. Based on calibration data, the condition of the choke valve may be more accurately monitored in advance of failure.

In one or more embodiments of the present invention, an improved closed-loop drilling system and method thereof enables low-specification applications to adopt and implement MPD without requiring the use of an expensive flow meter.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A method of closed-loop drilling comprising:

sealing an annulus surrounding a drill string with an annular sealing system;

isolating a fluid return line from the annulus with a wellbore isolation valve;

injecting calibration fluids from a secondary fluid pumping system into the fluid return line towards a choke valve;

determining a fluid density or specific gravity with a first meter disposed in line with the fluid return line upstream of the choke valve;

determining a first pressure upstream of the choke valve;

determining a second pressure downstream of the choke valve;

varying a commanded choke aperture setting of the choke valve through a plurality of set points and recording a pressure drop across the choke valve at each of the set points; and generating a choke performance curve, choke characteristic curve, or data thereof showing the commanded choke setting and corresponding pressure drop across the choke valve for a given fluid density and injection flow rate of the calibration fluids, wherein a data acquisition and control system monitors the condition of the choke valve by comparing choke performance curves, choke characteristic curves, or data thereof over the lifecycle of the choke valve, informing a crew when the choke performance curves, choke characteristic curves, or data thereof substantially change, indicating degradation or otherwise sub-optimal condition of the choke valve.

2. The method of claim 1, further comprising:

operating the choke valve during non-calibration operations in accordance with the choke performance curve or choke characteristic curve.

3. The method of claim 1, wherein the data acquisition and control system receives pressure measurements from a substantially vertical portion of the fluid return line or a substantially vertical device in line with the fluid return line, wherein a difference between the pressure measurements represents a hydrostatic pressure.

4. The method of claim 3, wherein the fluid density or specific gravity of the injected calibration fluids is determined by the data acquisition and control system by dividing a pressure drop across the substantially vertical portion of the fluid return line or the substantially vertical device in line with the fluid return line by a quantity calculated by multiplying a height of the substantially vertical portion or device by a unit conversion constant, resulting in a specific mud weight density in consistent units.

5. The method of claim 1, wherein the first meter is a poor man's density meter.

6. The method of claim 5, wherein the poor man's flow meter comprises a substantially vertical portion of the fluid return line or a substantially vertical device in line with the fluid return line.

7. The method of claim 6, wherein one or more pressure sensors are disposed on opposing sides of the substantially vertical portion or device to measure hydrostatic pressure across the substantially vertical portion.

8. The method of claim 1, wherein the first meter is a density meter.

9. The method of claim 1, wherein the first meter is a mass and volume flow meter.

10. The method of claim 1, wherein the first meter comprises a Coriolis meter.

11. The method of claim 1, wherein the first meter comprises a wedge flow meter.

12. The method of claim 1, wherein the first meter comprises a positive displacement flow meter.

13. The method of claim 1, wherein the data acquisition and control system compares choke performance curve data, choke position data, fluid density or specific gravity data, and pressure differential from a point upstream of the choke valve and downstream of the choke valve to estimate injection flow rate through the choke.

14. The method of claim 13, wherein the data acquisition and control system use an estimated injection flow rate through the choke valve as a primary indication of flow from an upstream process during non-calibration operations in the absence of other mass or volume flow meters.

15. The method of claim 13, wherein the data acquisition and control system use an estimated injection flow rate through the choke valve as a secondary indication of flow from an upstream process during non-calibration operations in conjunction other mass or volume flow meters.

* * * * *